United States Patent [19]

Sato et al.

[11] Patent Number: 4,847,476

[45] Date of Patent: Jul. 11, 1989

[54] ION SOURCE DEVICE

[75] Inventors: Tadashi Sato, Mito; Yasunori Ohno, Hitachi; Tomoe Kurosawa, Hitachi; Nobuya Sekimoto, Hitachi; Yoshimi Hakamata, Hitachi; Yukio Kurosawa, Hitachi; Kunio Hirasawa, Hitachi, all of Japan

[73] Assignee: Hitachi, Ltd., Tokyo, Japan

[21] Appl. No.: 942,635

[22] Filed: Dec. 17, 1986

[30] Foreign Application Priority Data

Jun. 16, 1986 [JP] Japan ..... 61-138092

[51] Int. Cl.[4] ..... H01J 27/00

[52] U.S. Cl. ..... 250/427; 250/423 R; 313/360.1

[58] Field of Search ..... 250/423 R, 427; 313/359.1, 360.1; 315/111.81

[56] References Cited

U.S. PATENT DOCUMENTS

| | | | |
|---|---|---|---|
| 4,277,939 | 7/1981 | Hyman | 313/360.1 |
| 4,383,177 | 5/1983 | Keller et al. | 250/423 R |
| 4,431,062 | 11/1984 | Kaufman et al. | 250/423 R |
| 4,491,735 | 1/1985 | Smith | 250/423 R |
| 4,529,571 | 7/1985 | Bacon et al. | 250/427 |
| 4,620,102 | 10/1986 | Watanabe et al. | 313/360.1 |

FOREIGN PATENT DOCUMENTS

| | | |
|---|---|---|
| 0054621 | 6/1982 | European Pat. Off. . |
| 0169744 | 7/1985 | European Pat. Off. . |
| 56-79900 | 6/1981 | Japan . |
| 57-18653 | 11/1982 | Japan . |

OTHER PUBLICATIONS

"High-Brightness High-Current ion Sources" Green, *Int. Phys. Conf.* Ser. No. 54, 1980, pp. 271-283.

*Primary Examiner*—Bruce G. Anderson

*Attorney, Agent, or Firm*—Antonelli, Terry & Wands

[57] ABSTRACT

An ion source device comprises a plasma generating vessel for generating plasma therein, a plurality of magnets arranged on an outer periphery of the plasma generating vessel to establish a cusp field in the plasma generating vessel, means for supplying a power to generate the plasma in the plasma generating vessel, and an anode electrode arranged on an inner wall of the plasma generating vessel and adapted to be heated by electrons emitted from the plasma and maintain the heat.

19 Claims, 6 Drawing Sheets

ION SOURCE DEVICE

BACKGROUND OF THE INVENTION

The present invention relates to an ion source device, and more particularly to an ion source device suitable for generating reactive ions.

In the ion source device, particularly in a high power ion source device, various discharges such as glow discharge, arc discharge and RF discharge are made in a low pressure discharge chamber to ionize gas in the discharge chamber so that ions are taken out of the plasma.

In such an ion source device, magnetic cusp fields are formed in the discharge chamber in order to generate plasma having a highly spatial uniformity. (See JP-A-No. 56-79900 and JP-A-No. 57-185653.)

In such a prior art device, an arc discharge is made by using a filament arranged in a plasma vessel as a cathode and a wall of the plasma vessel as an anode to ionize introduced gas, and the plasma is confined in the space in the vessel by utilizing the magnetic cusp fields so that they are effectively utilized. Magnetic characteristics of permanent magnets for generating the magnetic cusp fields degrades. In order to prevent the degradation of the magnetic characteristics of the permanent magnets for generating the magnetic cusp fields, the plasma vessel is cooled to prevent the temperature of the permanent magnets from rising too high.

However, in the ion source device utilizing the magnetic cusp fields, when a compound gas (fluorine or chlorine compound) is ionized to generate the plasma, electrical insulative high molecular product deposits on a wall of the plasma vessel by plasma polymerization reaction of the compound gas. Since the plasma vessel is an anode which is a positive electrode for a DC arc discharge, the discharge becomes unstable or discharge may be stopped and a basic operation of the ion source is interrupted and a stable discharge to the compound gas cannot be maintained.

SUMMARY OF THE INVENTION

It is an object of the present invention to provide an ion source device which can maintain discharge to a compound gas to generate stable plasma.

In accordance with the ion source device of the present invention, anodes are constructed such that the anodes which are heated by flow of electrons accelerated by the plasma are kept at high temperatures.

In accordance with one aspect of the present invention, the anodes are held on walls of a plasma vessel and/or an upper cover through a low thermal conductivity material or member.

In accordance with another aspect of the present invention, the anodes are shaped such that heat is prevented from conducting or dissipating from an area heated by the flow of electrons.

In accordance with a further aspect of the present invention, the anodes are made of a material to which plasma product hardly deposits.

DESCRIPTION OF THE PREFERRED EMBODIMENTS

Figure 1:
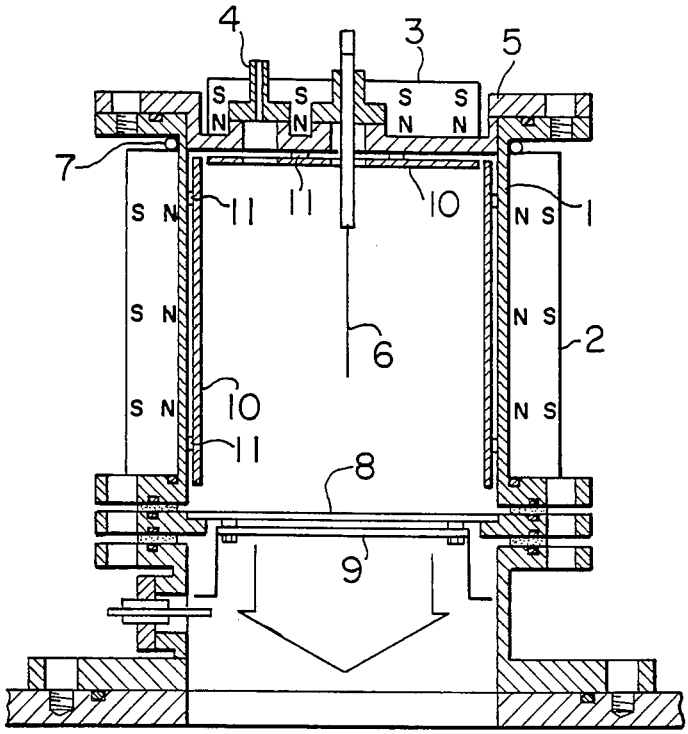
FIG. 1 shows a longitudinal sectional view of one embodiment of the present invention.

FIG. 1 shows a sectional view of one embodiment of the ion source device of the present invention. The ion source device has a generally cylindrical plasma generating vessel 1 on an outer circumference of which a plurality of permanent magnets 2 are arranged with alternate polarities. On the plasma generating vessel 1, an upper cover 5 having a plurality of permanent magnets 3 and a gas inlet port 4 for introducing gas containing a compound gas such as $CF_4$ (Tetrafluoromethane) or mixture of $CF_4$ and $A_r$, is provided. The upper cover 5 supports a cathode 6 which utilizes a hairpin-like tungsten filament arranged on a center axis of the plasma generating vessel 1. Ions in the plasma formed in the plasma generating vessel 1 are taken out as an ion beam shown by an arrow by electrodes 8 and 9 having a number of small apertures and radiated to a workpiece.

Figure 2:
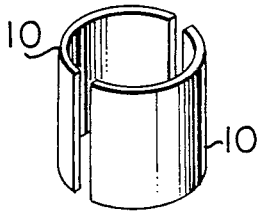
FIG. 2 shows a perspective view of a major portion of FIG. 1.

The plurality of permanent magnets 2 are arranged along the outer circumference of the vessel so that N poles and S poles thereof are directed to the center axis of the cylinder to establish magnetic line cusp fields in the vessel. Water cooling pipes 7 are arranged between respective permanent magnets to prevent degradation of the performance of the permanent magnets due to the temperature rise. An anode electrode 10 is arranged in the plasma generating vessel 1. The anode electrode 10 is made of non-magnetic stainless steel having a thickness of 0.5 mm and constructed by a cylinder having a length of 150 mm which is split into two parts along a center axis (see FIG. 2). A magnetic material 11 made of iron is spot-welded to an outer circumference of the anode. The magnetic material 11 is attracted by the permanent magnets 2 and held on the inner wall of the plasma generating vessel 1 so that the anode electrode 10 is fixedly held to the inner surface of the plasma generating vessel 1. The anode electrode 10 is not limited to the two-element structure but it may be three-element, four-element or eight-element structure. The upper cover 5 also supports an anode electrode 10 of a disc shape which achieves the same function as the cylindrical anode electrode 10.

Gas containing compound gas such as $CF_4$ or mixture of $CF_4$ and $A_r$ is introduced through the gas inlet port 4, and a DC voltage is applied across the cathode 6 having the tungsten filament and the anode 10 to ionize the gas by thermal electrons of the cathode to generate the plasma, an ion beam is taken out from the plasma by the electrodes 8 and 9 and it is radiated to the workpiece.

As described above, by providing the anode electrode 10 in the plasma generating vessel 1 through the iron member 11 having a small sectional area, the anode 10 is electrically connected to the plasma generating vessel 1 and thermally insulated, and hence it is not cooled and the electrons accelerated between the anode electrode 10 and the plasma flow into to heat the anode electrode 10. Accordingly, the anode electrodes 10 are kept at much higher temperature than the plasma generating vessel 1. As a result, electrical insulative high molecular material generated by the discharge of the compound gas hardly deposits on the anode electrodes 10 and unstable discharge and stoppage of discharge are prevented, and the basic operation of the ion source device is significantly improved, and stable discharge is maintained to the compound gas.

Figure 3:
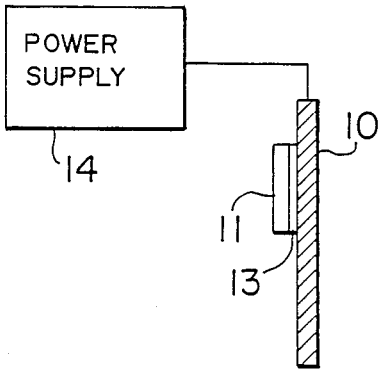
FIG. 3 shows a sectional view of another embodiment of the major portion of FIG. 1, FIGS. 4 and 5 show longitudinal sectional views of other embodiments of the present invention.

When a large diameter plasma generating vessel 1 such as the inner diameter "600 mm" is used, a hot anode electrode like the anode electrode 10 is necessary at the upper cover 5 because main discharge is done between the upper cover 5 and the cathode 6. When a portion of the magnetic material 11 which supports the anode electrode 10 is insulated by an insulative material 13 as shown in FIG. 3, a different potential than that of the plasma generating vessel 1 can be applied to the anode electrode 10 from a power supply 14. Thus, an appropriate voltage can be applied to the anode to improve confinement of electrons or ions. At the beginning of the operation upon energization of the ion source device, the anode electrode 10 is at a room temperature and the insulative high molecular product may deposit on the anode electrode to cause the discharge unstable. In such a case, plasma is formed by $A_r$ gas or $H_2$ gas to preheat the anode electrode 10, and after the anode electrode 10 has been heated, $CF_4$ gas is introduced to maintain stable discharge. By arranging a temperature sensor such as a thermocouple on the anode electrode 10, it was confirmed that the stable discharge is attained when the anode electrode 10 is at 150°–200° C. or higher.

By keeping the anode electrode 10 at a high temperature, the deposition of the electrical insulative high molecular product is prevented but a low molecular solid such as carbon deposits. Even in such a case, the anode electrode 10 can be readily exchanged or cleaned because the anode electrode 10 is fixed by magnetic force.

However, since the exchange or cleaning of the anode electrode 10 requires reevacuation of the plasma generating vessel 1 by a vacuum pump, a considerable time loss accompanies. When hydrogen plasma is utilized, the high molecular product such as fluorine or chlorine deposited on the high temperature anode electrode 10 is decomposed by the reduction by the hydrogen ions and fluorine contained in carbon can be fed out of the system by a vacuum pump so that stable discharge is recovered and maintenance work such as exchange or cleaning of the anode electrode 10 is relieved.

Figure 4:
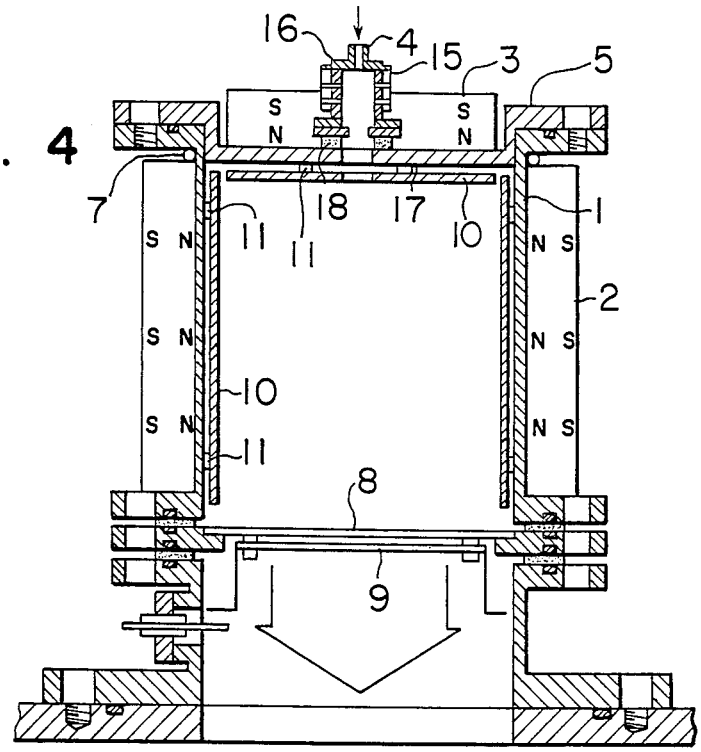

FIG. 4 shows other embodiment of the present invention. Instead of the cathode 6 having the tungsten filament shown in FIG. 1, electrons taken out of the plasma by electrodeless discharge such as RF plasma or microwave plasma, and a hollow cathode are used. In the present embodiment, a glass tube 16 having a gas inlet port 4 and an RF coil 15 is arranged at the center of the upper cover 5 of the plasma generating vessel having the permanent magnets 3, through an electron take-out electrode 17 and an insulative spacer 18. Electrons are generated in the glass tube and radiated into the plasma generating vessel 1. Other constructions are identical to those of the embodiment shown in FIG. 1.

In the present embodiment, stable discharge is maintained. Because there is no filament which is broken at 2000° C.–3000° C., the exchange of the filament may be omitted.

Figure 5:
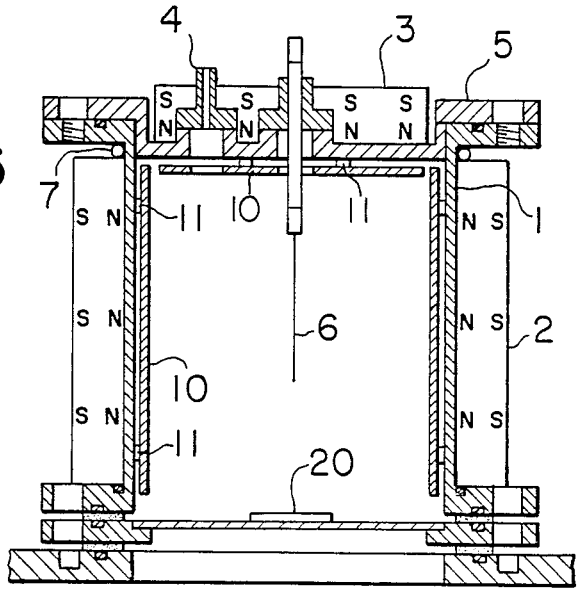

In an embodiment shown in FIG. 5, a workpiece 20 is mounted at a position of the take-out electrodes 8 and 9 in the ion source device shown in FIG. 1 to expose the workpiece 20 directly to the plasma to enable etching. The same advantages as those in FIG. 1 are attained. Further, since the ions are not accelerated, the damage to the workpiece by the ion beam bombardment is minimum.

Figure 6A:
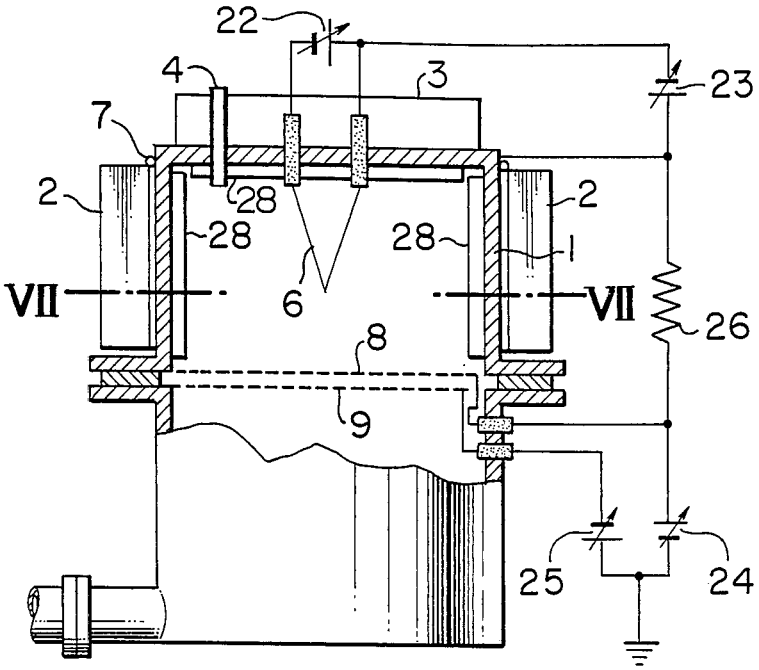
FIG. 6A shows a further embodiment of the present invention.
Figure 6B:
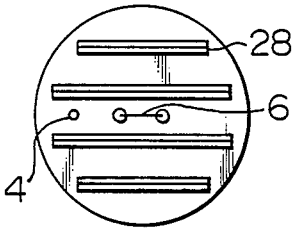
FIG. 6B shows a plane view on the inside of the upper cover in FIG. 6A.
Figure 7:
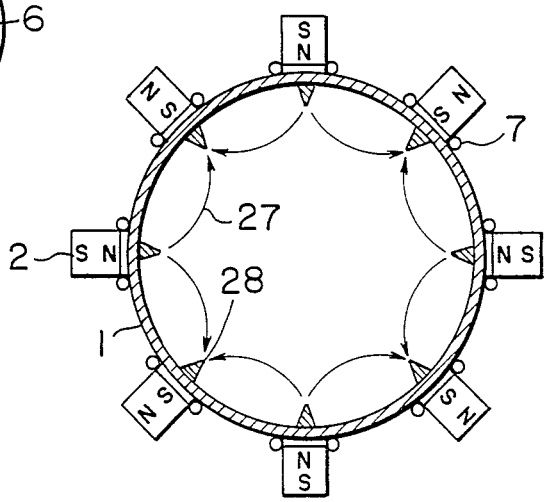
FIG. 7 shows a sectional view taken along a line VII—VII in FIG. 6.

FIGS. 6 and 7 show other embodiment of the present invention. Gas containing a compound such as $CF_4$ or mixture of $CF_4$ and $A_r$ is introduced from the gas inlet port 4. The cathode 6 having the filament to which a current is supplied from a power supply 22 is arranged in the cylindrical plasma generating vessel 1. A DC voltage is applied across the cathode 6 and the vessel 1 from a power supply 23, and the gas is ionized by thermal electrons emitted from the cathode 6 to form the plasma in the vessel 1. Appropriate voltages are applied from power supplies 24 and 25 to the take-out electrodes 8 and 9 having a number of small apertures for taking out the ions from the plasma. The electrode 8 is connected to the vessel 1 through a resistor 26. A number of permanent magnets 2 establish a line cusp field 27 in the plasma generating vessel 1. Water cooling pipes 7 are arranged around the permanent magnets 2 to prevent the degradation of the performance due to the temperature rise of the permanent magnets.

On the inner wall of the plasma generating vessel 1, an electrode 28 electrically connected to the vessel 1 is arranged along the inner circumference with the longitudinal direction thereof being oriented along the axis of the vessel 1. The electrode 28 is preferably arranged at the center of the line cusp field, that is, inside of the permanent magnets 2.

The electrons emitted from the cathode 6 ionize the gas and move toward the inner wall of the vessel 1 which is the anode. They make spiral motion by the line cusp field 27 established by the permanent magnets 2. Most of them concentrate to the end of the electrode 28 at which magnetic fluxes and electric field concentrate. Accordingly, the end of the projection is continuously heated to a high temperature by the electron bombardment and joule heat so that the deposition of the electrical insulative reaction product is prevented and stable arc discharge is attained.

Figure 8:
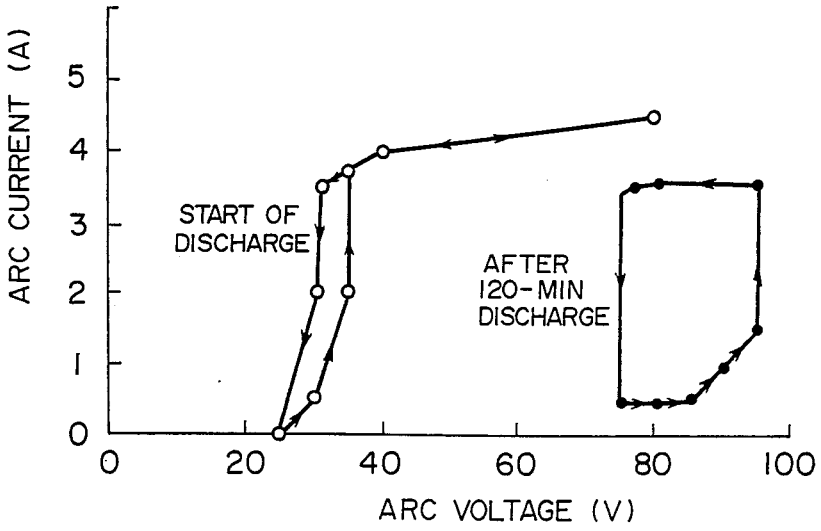
FIG. 8 PRIOR ART
FIG. 8 shows a graph of a plasma characteristic in a prior art device.
Figure 9:
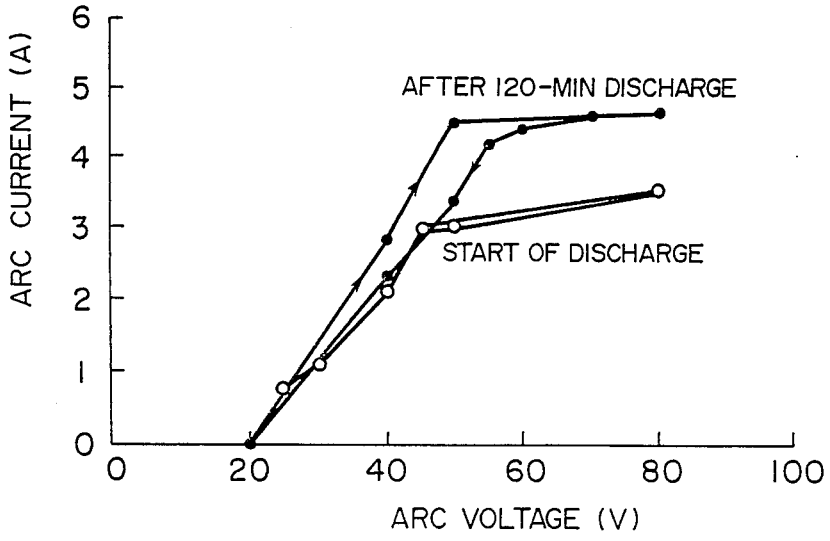
FIG. 9 shows a graph of a plasma characteristic in the present invention.

Examples of discharge characteristics of a prior art device and the present device are shown in FIGS. 8 and 9. They show relationships between the voltages of the arc power supply 23 and the arc currents at a constant filament current under $CF_4$ gas.

FIG. 8 shows the discharge characteristic of the prior art device. At the beginning of discharge when the plasma generating vessel is not dirty, the arc discharge start at approximately 30 volts. After the discharge at the arc voltage of 80 volts for 120 minutes, the $CF_4$ reaction product has been deposited on the inner wall of the plasma generating vessel so that the arc discharge is stopped if the arc voltage is dropped to 75 volts. In order to restart the arc discharge, the arc voltage must be raised to 95 volts.

In the present device, as shown in FIG. 9, the discharge starts at approximately 20 volts after 120 minutes discharge, and stable arc discharge is attained with the arc voltage of 50 volts or higher.

Figure 10:
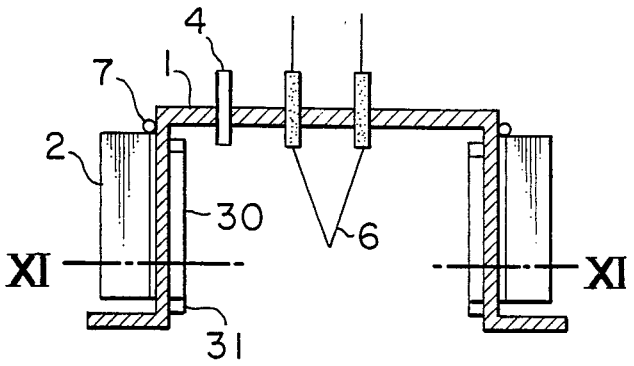
FIG. 10 shows a longitudinal sectional view of other embodiment of the present invention.
Figure 11:
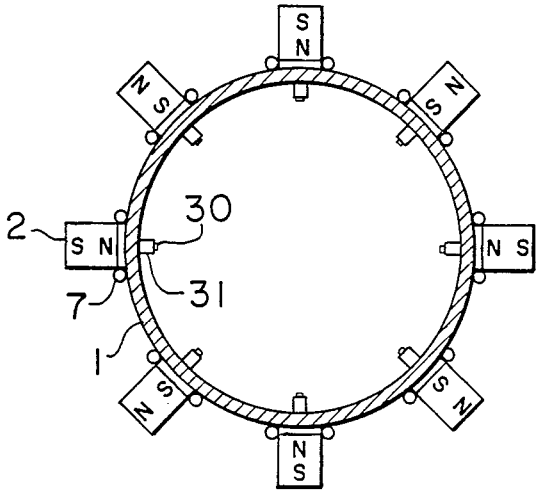
FIG. 11 shows a sectional view taken along a line XI—XI in FIG. 10, FIGS. 12 to 15 show perspective views of embodiments of major portion of the present invention.

FIGS. 10 and 11 show other embodiment of the present invention. In the present embodiment, conductive support members 31 are arranged in the vessel 1 in which the permanent magnets 2 are arranged, and conductive wires 30 are spanned therebetween. The electrons concentrate to the wires 30 so that the wires 30 are kept at a high temperature. Further, the wires 30 can be arranged on the inside of the upper cover as shown in FIGS. 6A and 6B.

In the embodiments so far explained, the projections or wires are directly attached to the vessel. Alternatively, an anode having projections or wires may be arranged in the plasma vessel.

Figure 12:
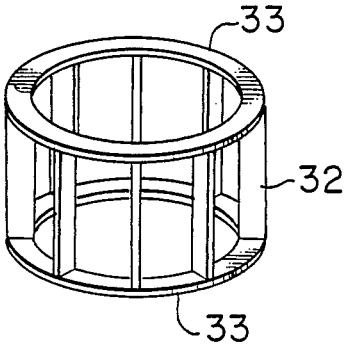

FIG. 12 shows an anode having projections 32 which are fixed by rings 33. The anode is mounted such that the projections 32 generally align to the permanent magnets arranged on the vessel. In this manner, the advantage described above is attained.

Figure 13:
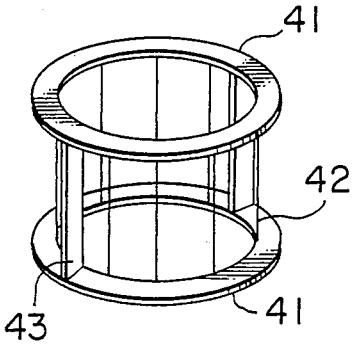

FIG. 13 shows an anode having conductive wires 42 spanned between rings 41 supported by support members 43. The conductive wires 42 are generally aligned to the permanent magnets arranged on the vessel.

In the embodiments shown in FIGS. 12 and 13, the anode assembly can be taken out of the vessel and the maintenance of the anode is facilitated.

Figure 14:
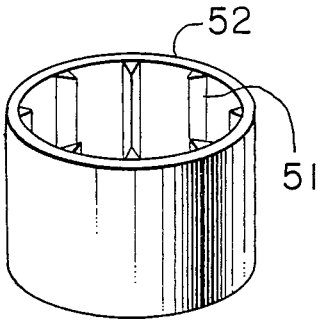
Figure 15:
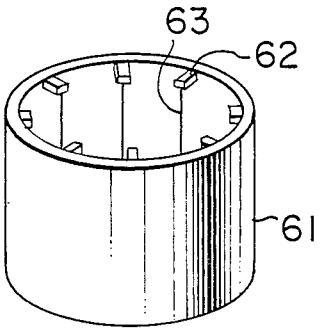

FIGS. 14 and 15 show other embodiments of the anode. In FIG. 14, projections 51 are formed on the inner circumference of the conductive cylinder 52. In FIG. 15, conductive wires 63 are spanned between support members 62 formed on the inner circumference of the conductive cylinder 61. The projections 51 or the conductive wires 62 are generally aligned to the permanent magnets arranged on the plasma vessel. Thus, stable arc discharge is attained by the reason described above. Further, since the inner wall of the plasma generating vessel is covered by the cylinder, the inner wall of the plasma generating vessel is not contaminated by the discharge. Accordingly, when the type of discharge gas is to be changed, the affect by the previous gas is eliminated by simply exchanging the anode.

In the embodiments shown in FIGS. 6, 10 and 12–15, the projections or the like are provided on the cylinder of the plasma generating vessel 1, where the permanent magnets are arranged not only on the circumference of the cylinder of the vessel 1 but also on the upper cover 5 as shown in FIGS. 1, 4 and 5, the projections may also be provided on the vacuum vessel near the magnets in order to improve the confinement efficiency of the plasma. When the projections are made of material having a lower conductivity than copper, the joule heat can be effectively utilized. When the projections are made of magnetic material, the magnet poles of the cusp fields completely align with the incident positions of electrons.

In the above embodiments, at the beginning of generation of plasma, the anode electrode 10 or projecting electrodes 28 have not yet been fully heated and the plasma product may deposit on those electrodes. Even after the anode electrodes have been heated, it is not assured that no plasma product deposit on those electrodes, but certain amount of plasma product may deposit. In such a case, when the type of gas to be ionized is changed, the plasma product deposited in the previous step evaporate and it is mixed with the newly produced plasma product to result in an undesirable product. Accordingly, when the anode electrode is exchanged or cleaned, the vessel must be evacuated by the vacuum pump and a considerable time is required for that work. In a further embodiment of the present invention, the anode electrode is made of such a material that will react with the plasma product deposited on the anode electrode to produce a compound which is readily vaporized. For example, the anode electrode 10, projecting electrodes 28, 32, 51 or wires 30, 42, 63 are made of molybdenum $M_o$ and the gas $CF_4$ is introduced into the plasma generating vessel 1 to generate plasma. Thus, on the surface of the heated anode electrode, $M_oF_6$ is produced by the following reaction.

$$3CF_4+2M_o \rightarrow 3C+2M_oF_6$$

The $M_oF_6$ is readily vaporized because the anode electrode is heated to a very high temperature, and it is removed with the ion beam. In this manner, the plasma product deposited on the anode electrode reacts with the electrode and the deposition of the plasma product to the anode electrode is materially reduced. As a result, the plasma product is hard to deposit on the anode electrode an stable plasma characteristic is attained.

In the present embodiment, the anode electrode is made of molybdenum although other material such as tungsten which reacts with the plasma product to produce a compound which is readily vaporized may be used.

We claim:

1. An ion source device comprising:

a plasma generating vessel for generating plasma therein;

a plurality of magnets arranged around an outer periphery of said plasma generating vessel to establish a plurality of magnetic cusp fields in said plasma generating vessel;

means for supplying a power to generate the plasma in said plasma generating vessel; and a plurality of spaced anode electrodes spaced from one another, electrically conductively connected to said plasma generating vessel, and arranged on an inner surface of said plasma generating vessel at least at positions facing said plurality of magnets so that said spaced anode electrodes are heated by electrons emitted from the plasma to maintain the heat thereof at a temperature sufficient to prevent deposits.

2. An ion source device according to claim 1 wherein said anode electrodes comprise linear areas.

3. An ion source device according to claim 2 wherein said linear areas are projecting wires.

4. An ion source device according to claim 2 wherein said linear areas are wires.

5. An ion source device according to claim 2 wherein said linear areas are made of magnetic material.

6. An ion source device according to claim 1 further comprising a member for supporting said anode electrode to said plasma generating vessel.

7. An ion source device according to claim 6 wherein said member is made of an essentially thermally insulative material.

8. An ion source device according to claim 6 wherein said member is made of an electrically conductive material.

9. An ion source device according to claim 6 wherein said member is made of a magnetic material.

10. An ion source device according to claim 1 wherein said anode electrodes are made of a relatively low conductivity material.

11. An ion source device according to claim 1 wherein said anode electrodes are made of a material which reacts with a material produced in the plasma to produce a compound which is readily vaporized.

12. An ion source device according to claim 11 wherein said material is molybdenum.

13. An ion source device according to claim 11 wherein said material is tungsten.

14. An ion source device according to claim 1 wherein the electrons are generated by electrodeless discharge.

15. An ion source device according to claim 1 further comprising a cathode for emitting electrons into said plasma generating vessel.

16. An ion source device according to claim 15 wherein said cathode is a filament.

17. An ion source device according to claim 1 further comprising a take-out electrode for taking out an ion beam from the plasma for irradiation to a workpiece.

18. An ion source device according to claim 1 wherein said plasma is irradiated directly to a workpiece.

19. An ion source device to comprising:

a plasma generating vessel for generating plasma therein;

a plurality of magnets arranged around an outer periphery of said plasma generating vessel to establish a plurality of magnetic cusp fields in said plasma generating vessel;

means for supplying a power to generate the plasma in said plasma generating vessel;

a plurality of spaced anode electrodes spaced from one another and arranged on an inner surface of said plasma generating vessel at least at positions facing said plurality of magnets so that said spaced anode electrodes are heated by electrons emitted from the plasma to maintain the heat thereof at a temperature sufficient to prevent deposits; and a member for supporting said anode electrodes to said plasma generating vessel, said member including an insulator for insulating said plasma generating vessel from said anode electrodes and a power supply for supplying a voltage to said anode electrodes.

* * * * *